US010597964B2

(12) United States Patent
Beazer et al.

(10) Patent No.: US 10,597,964 B2
(45) Date of Patent: Mar. 24, 2020

(54) WIRELINE DEPLOYED MULTI-STAGE STIMULATION AND FRACTURING SYSTEM

(71) Applicants: Lee Energy Systems Inc., Calgary (CA); Sean Patrick Grant Hervo, Calgary (CA)

(72) Inventors: Dayln Keith Beazer, Calgary (CA); Paul Bernard Lee, Kelowna (CA); Sean Patrick Grant Hervo, Calgary (CA)

( * ) Notice: Subject to any disclaimer, the term of this patent is extended or adjusted under 35 U.S.C. 154(b) by 156 days.

(21) Appl. No.: 15/910,426

(22) Filed: Mar. 2, 2018

(65) Prior Publication Data

US 2019/0186224 A1 Jun. 20, 2019

(30) Foreign Application Priority Data

Dec. 20, 2017 (CA) ..... 2988409

(51) Int. Cl.

| | |
|---|---|
| ***E21B 29/00*** | (2006.01) |
| ***E21B 43/26*** | (2006.01) |
| ***E21B 34/14*** | (2006.01) |
| ***E21B 34/10*** | (2006.01) |
| ***E21B 33/127*** | (2006.01) |
| ***E21B 47/06*** | (2012.01) |
| ***E21B 34/00*** | (2006.01) |
| ***E21B 43/25*** | (2006.01) |
| ***E21B 47/12*** | (2012.01) |
| ***E21B 47/09*** | (2012.01) |
| ***E21B 23/01*** | (2006.01) |

(52) U.S. Cl.

CPC ..... *E21B 29/005* (2013.01); *E21B 23/01* (2013.01); *E21B 33/127* (2013.01); *E21B 34/10* (2013.01); *E21B 34/14* (2013.01); *E21B 43/26* (2013.01); *E21B 43/25* (2013.01); *E21B 47/06* (2013.01); *E21B 47/065* (2013.01); *E21B 47/09* (2013.01); *E21B 47/12* (2013.01); *E21B 2034/007* (2013.01)

(58) Field of Classification Search

CPC ..... E21B 29/005; E21B 43/26; E21B 34/14; E21B 34/10; E21B 33/127; E21B 23/01; E21B 47/06; E21B 2034/007; E21B 43/25; E21B 47/12; E21B 47/065; E21B 47/09

See application file for complete search history.

(56) References Cited

U.S. PATENT DOCUMENTS

| | | | |
|---|---|---|---|
| 6,394,184 B2 | 5/2002 | Tolman et al. | |
| 6,543,538 B2 | 4/2003 | Tolman et al. | |
| 2010/0089583 A1* | 4/2010 | Xu | E21B 10/322 166/298 |

FOREIGN PATENT DOCUMENTS

| | | |
|---|---|---|
| CA | 2397460 | 8/2001 |

* cited by examiner

*Primary Examiner* — Wei Wang
(74) *Attorney, Agent, or Firm* — Field LLP

(57) ABSTRACT

A multi-stage stimulating system is provided. The system is wireline deployed comprises one or more hydraulic sealing devices, hydraulic anchors and a mechanical cutter or a shifting tool, further comprising an accumulator-pump unit in the system to provide a fluid source for hydraulically actuating the sealing devices, anchors and cutter. A method is further provided of stimulating multiple intervals of a subterranean formation by running a bottom hole assembly down a wellbore casing on a wireline.

15 Claims, 6 Drawing Sheets

WIRELINE DEPLOYED MULTI-STAGE STIMULATION AND FRACTURING SYSTEM

FIELD OF THE INVENTION

The present invention relates to systems and methods for stimulation of multiple intervals of a wellbore formation.

BACKGROUND OF THE INVENTION

In extracting hydrocarbons from subterranean formations it is often necessary to increase permeability and flow of hydrocarbons out of formation and into a wellbore to be pumped to surface for production. One method of increasing permeability is to stimulate the formation through perforations formed in a casing running down the wellbore.

In some cases there are multiple hydrocarbon-bearing intervals in the formation and it is desirable to stimulate and then produce from each of these intervals. Commonly, the process is conducted by stimulating or fracturing one interval at a time. Such process is known as multi-stage stimulating.

In multi-stage stimulating it is desirable to isolate a particular interval to be stimulated, perforate the casing in that interval, stimulate or fracture the interval, then move to a next interval to be isolated, perforated and stimulated. These steps are achieved by running a tool string down into the casing of the wellbore, the tools string having an sealing device, a perforating device and may also include other devices for locating the tool string at the interval to be stimulated and anchoring the tools string to the casing to maintain position. Sealing devices can include bridge plugs, packers, ball sealers, sliding sleeves and straddle packers. These sealing devices may be hydraulically activated or mechanically activated from the surface. Perforating devices include explosive perforating charges fired from a perforating gun, high-pressure fluid perforators, sand jet perforating, burst disk or burst plug inserts among others. Anchoring devices commonly have slips with toothed surfaces for gripping against an inner surface of the casing to prevent axial and sometimes also radial movement of the tool string within the casing.

The tool string, also often called a bottom hole assembly (BHA), is typically run into the wellbore casing on coiled tubing or on jointed tubing. In such cases, fluid from the surface can be pumped through the coiled or jointed tubing into the tubing string to actuate isolating, anchoring and perforating devices. Alternately, the tubing can be mechanically manipulated at surfaces by pulling, pushing or turning, to actuate the various devices of the tool string.

One disadvantage of running a tool string on coiled or jointed tubing is that the inside diameter (ID) of the coiled or jointed tubing presents a reduced flow cross-sectional area than that of the full ID of casing itself. Furthermore, should fluid be flowed in the annulus between the outside diameter (OD) of the coiled or jointed tubing and the ID of the casing, this also presents reduced cross sectional area than the casing alone. Reduced cross sectional area is disadvantageous in that it increases frictional losses for fluids flowing through the narrower annulus. Surface pumps pumping the fluid into the narrow annulus are required to pump at much greater power to achieve the needed flow rates for stimulation and pumps often reach their maximum pumping power without reaching the needed flow rates.

U.S. Pat. No. 6,394,184 to Tolman et al. teaches a BHA for stimulating multiple intervals of a formation in which the BHA may be run on coiled tubing or jointed tubing. It also teaches one embodiment in which the BHA for stimulating multiple intervals can be run on a wireline. Tolman et al. teaches slips that are mechanically set using axial up and down movement of the tubing or wireline on which they are run. With respect to a wireline deployed BHA, Tolman also teaches a resettable inflatable packer that is connected to an electrical pump system that inflates or deflates the inflatable packer using wellbore fluid. The perforating devices of Tolman are either select-fire perforating guns or abrasive/erosive fluid-jet cutting tools.

There are a number of disadvantages to use of combined hydraulic and mechanical devices on the single BHA. For example, mechanically actuated devices needing axial movement of the string can interfere with proper locating and setting of other tools that do not need mechanical movement to set. As well, use of wellbore fluid to set any devices can introduce wellbore contaminants into the tool string increasing the risk of plugging the devices with wellbore debris and also increasing wear and damage.

Changing wellbore fluid properties like temperature and viscosity can also adversely affect actuation of hydraulic set tools.

It is therefore desirable to provide BHA's that do not limit fluid flow through the casing and which also reduce unpredictability of actuation.

SUMMARY

A multi-stage stimulating system is provided. The system is wireline deployed comprises one or more hydraulic sealing devices, hydraulic anchors and a mechanical cutter, further comprising an accumulator-pump unit in the system to provide a fluid source for hydraulically actuating the sealing devices, anchors and cutter.

A method is further provided of stimulating multiple intervals of a subterranean formation. The method comprises the steps of: running a bottom hole assembly down a wellbore casing on a wireline, said bottom hole assembly comprising: one or more hydraulic sealing devices, one or more hydraulic anchors, a mechanical cutter, an accumulator to provide a fluid source and a pump fluidly connected to the accumulator; pumping fluid from the accumulator to the mechanical cutter to hydraulically actuate the mechanical cutter; cutting one or more perforations into the casing to form access points to the formation; pumping fluid out of the mechanical cutter to de-activate the mechanical cutter; repositioning the bottom hole assembly; pumping fluid from the accumulator to the one or more hydraulic sealing devices and one or more hydraulic anchors to hydraulically actuate the one or more hydraulic sealing devices and one or more hydraulic anchors to isolate the interval of the formation to be stimulated; stimulating the interval of the formation through the access points with fluid delivered through the casing; pumping fluid out of the one or more hydraulic sealing devices and one or more hydraulic anchors to deactivate the one or more hydraulic sealing devices and one or more hydraulic anchors; and repositioning the bottom hole assembly. The steps of the method are repeated for every interval of the formation to be stimulated.

A multi-stage stimulating system is further provided. The system comprises one or more hydraulic sealing devices; one or more hydraulic anchors; a hydraulic shifting tool; an accumulator to provide a fluid source; and a pump fluidly connected to the accumulator for pumping fluid to and hydraulically actuating the one or more sealing devices, one or more anchors and the shifting tool. The system is deployed via wireline.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. The drawings depict only typical embodiments of the invention and are therefore not to be considered limiting of its scope. In the drawings.

The drawings are not necessarily to scale and in some instances proportions may have been exaggerated in order more clearly to depict certain features.

DETAILED DESCRIPTION OF VARIOUS EMBODIMENTS

The description that follows and the embodiments described therein are provided by way of illustration of an example, or examples, of particular embodiments of the principles of various aspects of the present invention. These examples are provided for the purposes of explanation, and not of limitation, of those principles and of the invention in its various aspects.

The present invention relates to systems and methods for multi-stage stimulation and fracturing for opening and stimulating multiple intervals of a well in a single run. The system is deployed on wireline in order to allow full bore access during stimulation. With full bore flow area, the frictional losses are lower and therefore allow surface pumps to pump at higher rates before they reach their maximum pressures. Flowing down a full bore without a flow restriction allows penetration into deeper wells with higher rates. It lowers the hydraulic power required to do a treatment. This allows more flexibility in stimulating or fracturing the well bore without limitations to pumping rates that can occur with pumping down tubing or annular stimulations in the annulus between a tubing and the casing, which restrict the total flow through pumping area.

The present invention more particularly relates to a wireline deployed multi-stage stimulating system comprising hydraulic sealing devices, hydraulic anchors and a mechanical cutter or a shifting tool, further comprising an accumulator and a pump unit to provide a fluid source that is isolated from wellbore fluid, for hydraulically actuating the sealing devices, anchors and cutter.

Figure 1A:
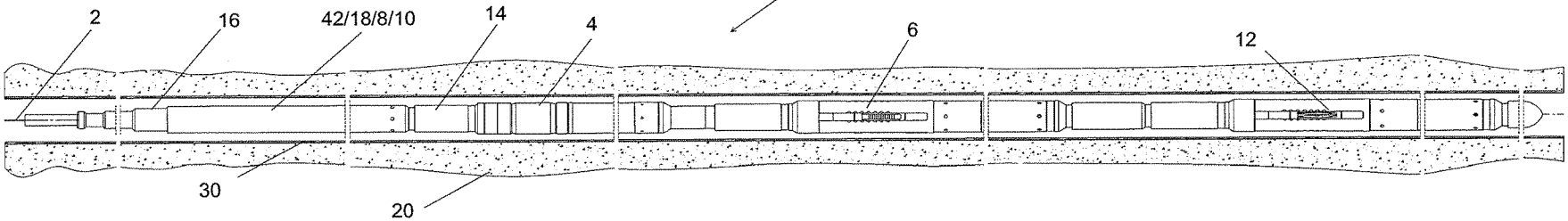
FIG. 1*a* is an elevation view of one embodiment of the system of the present invention.
Figure 1B:
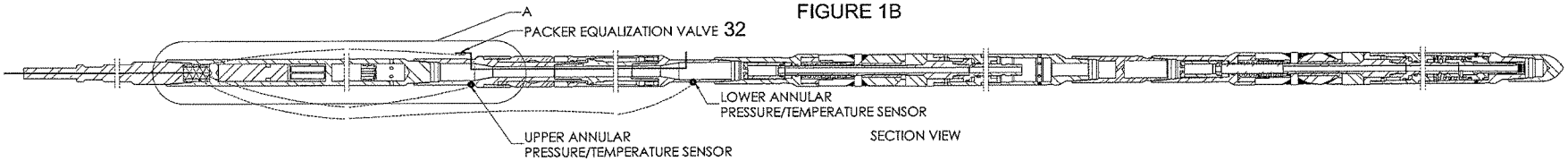
FIG. 1*b* is a cross sectional view of FIG. 1*a,*
Figure 5:
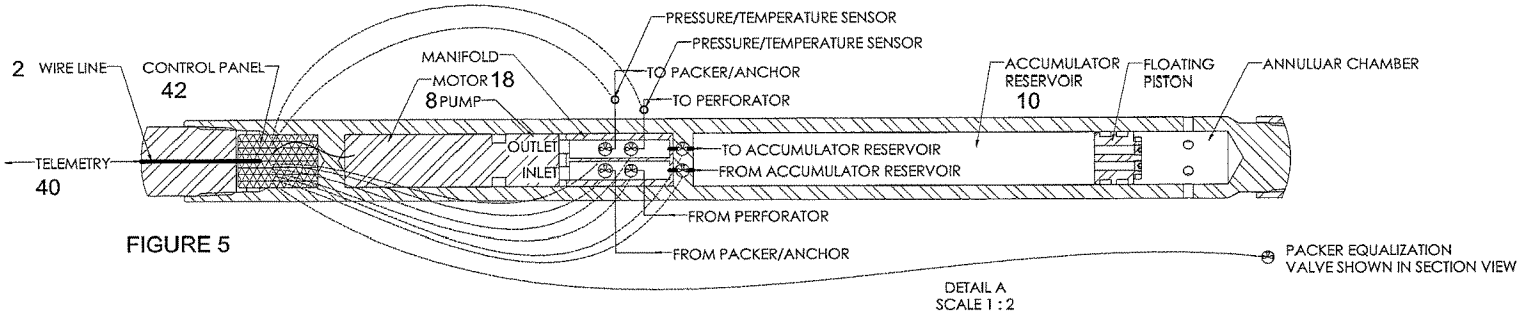
FIG. 5 is a detailed view of section A of FIG. 1*b*, depicting the one embodiment of the accumulator-pump unit for use with the present invention.
Figure 2B:
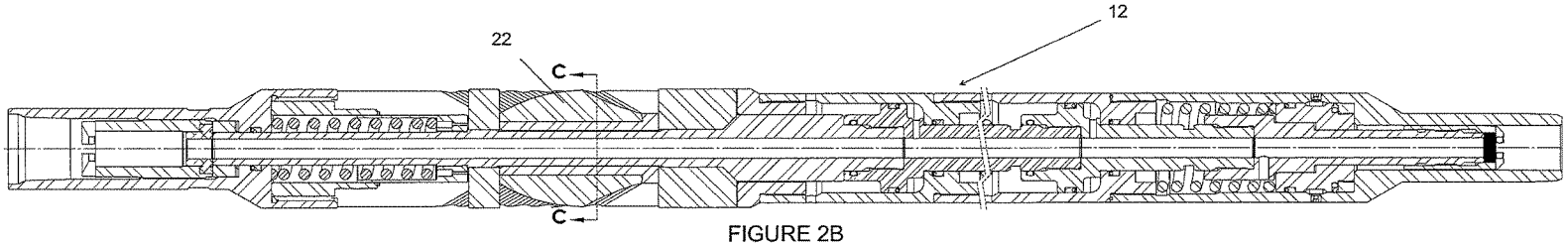
FIG. 2*b* is a side cross sectional view along line A-A of FIG. 2*a;*
Figure 2A:
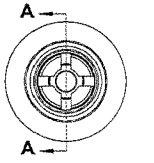
FIG. 2*a* is an end view of one embodiment of a hydro-mechanical cutter for use with the present invention, in a blade disengaged position.
Figure 2E:
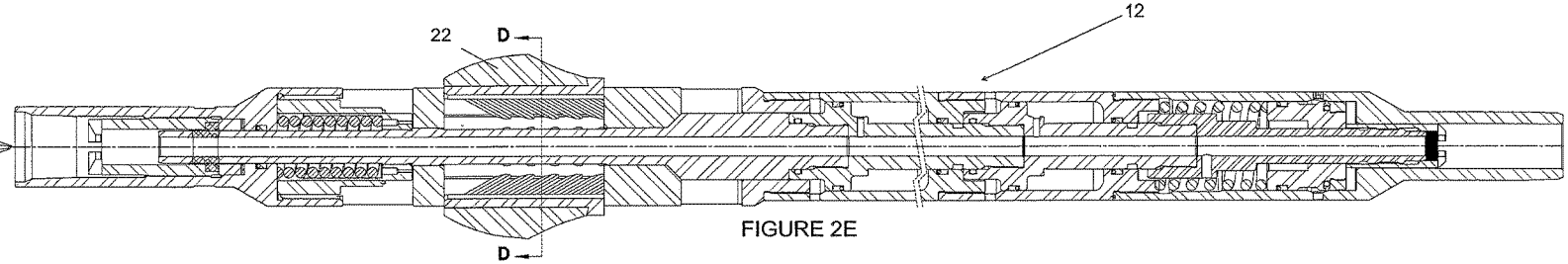
FIG. 2*e* is a side cross sectional view along line B-B of FIG. 2*d;*
Figure 2D:
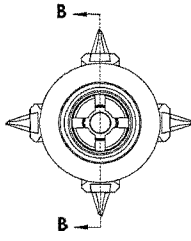
FIG. 2*d* is an end view of one embodiment of a hydro-mechanical cutter for use with the present invention, in a blade engaged position.
Figure 2C:
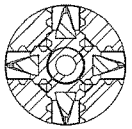
FIG. 2*c* is an end cross section view taken along lines C-C of FIG. 2*b;*
Figure 2F:
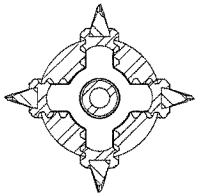
FIG. 2*f* is an end cross sectional view taken along line D-D of FIG. 2*e;*
Figure 2G:
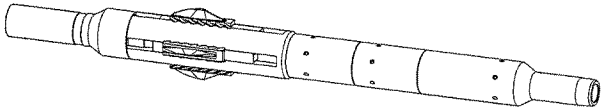
FIG. 2*g* is a perspective view of one embodiment of a hydro-mechanical cutter for use with the present invention, in a blade engaged position.
Figure 3B:
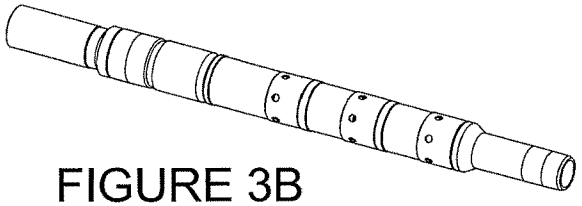
FIG. 3*b* is a perspective view of the sealing device of FIG. 3*a;*
Figure 3A:
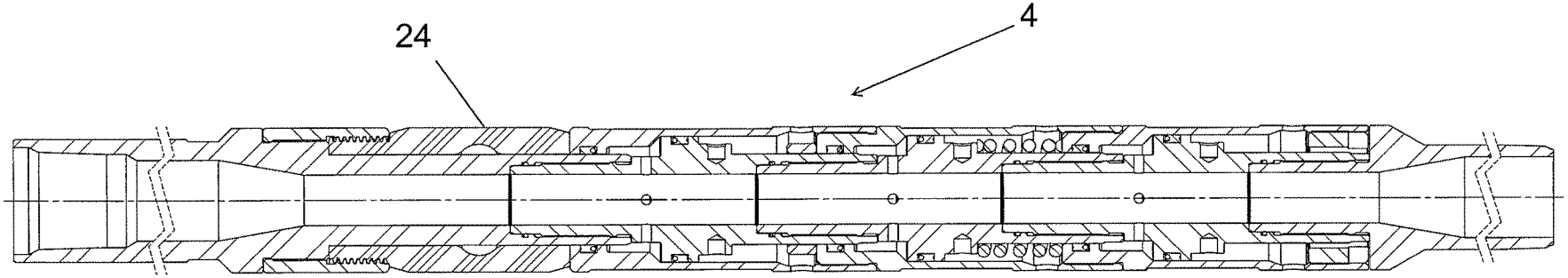
FIG. 3*a* is a side cross sectional view of one embodiment of a hydraulic sealing device for use with the present invention in an unactuated position.
Figure 4A:
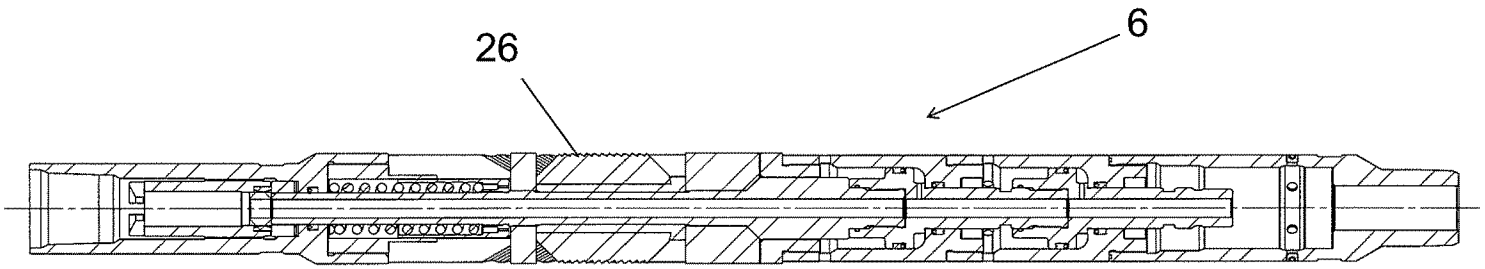
FIG. 4*a* is a cross sectional view of one embodiment of a hydraulic anchor for use with the present invention in an unactuated position.
Figure 4B:
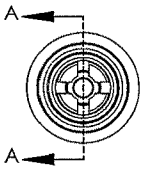
FIG. 4*b* is an end cross sectional view of the anchor of FIG. 4*a;*
Figure 6:
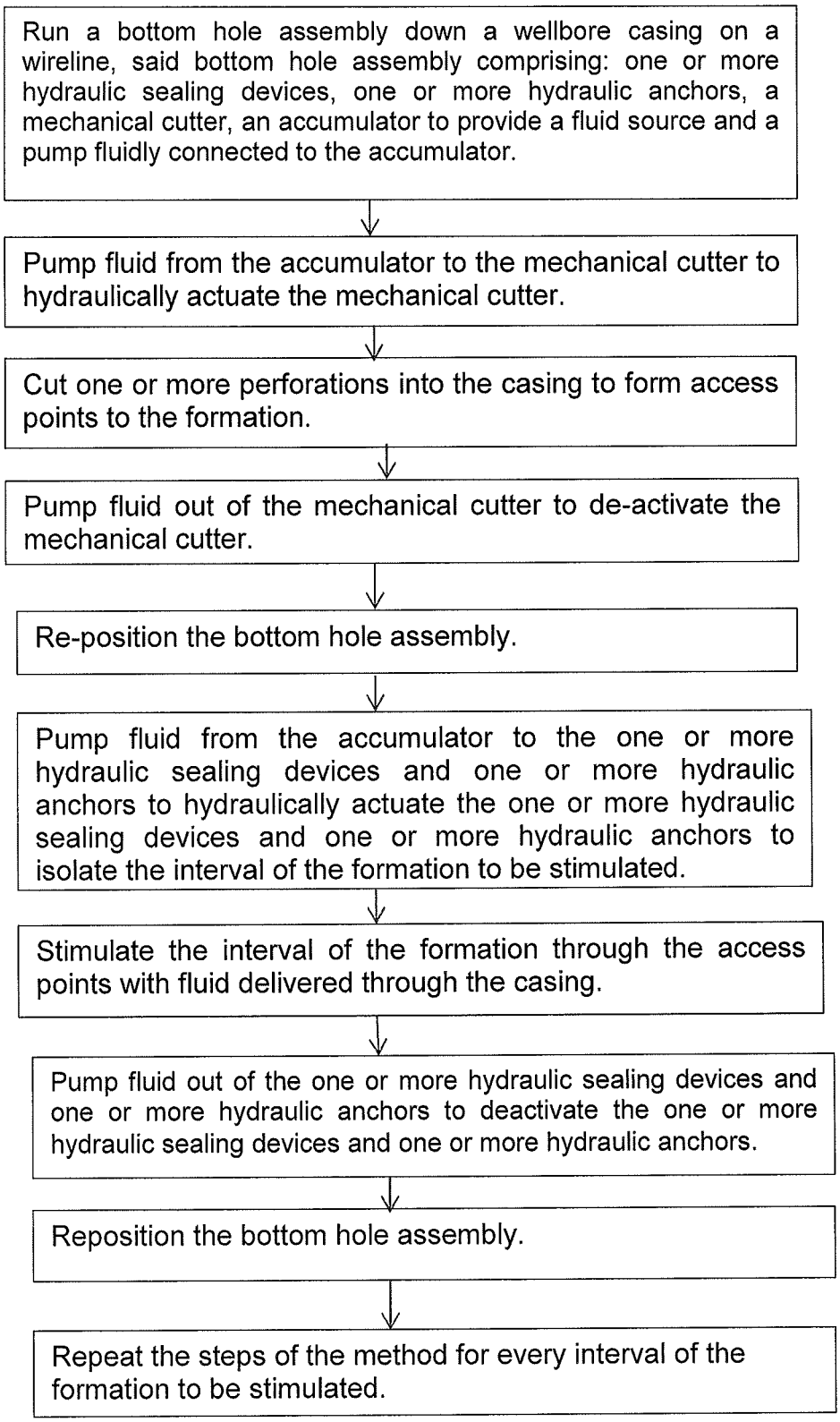
FIG. 6 is a schematic diagram of a method of the present invention.
Figure 7:
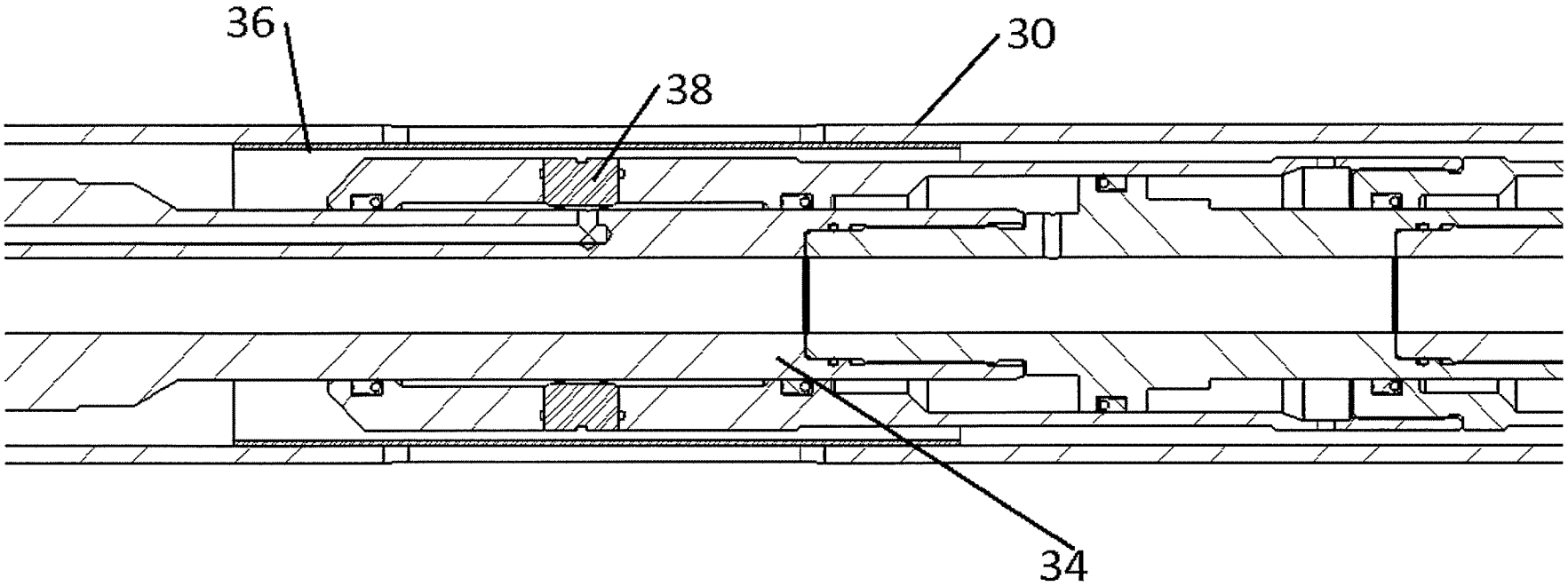
FIG. 7 is a cross sectional view of one embodiment of the shifting tool of the present invention.

With reference to the present figures, in one embodiment, the present BHA system 100 comprises a wireline 2 on which is run one or more hydraulic sealing devices 4, one or more hydraulic anchors 6, a pump 8 with motor 18, an accumulator 10, and a mechanical cutter 12. In the embodiment of FIG. 7, the mechanical cutter 12 is replaced with a shifting tool 34. The system 2 may also comprise a locator means 14 for locating the system 100 in a particular interval of the formation 20 by lining up with certain features of the casing 30 into which the system is run.

A cable head 16 optionally connects the wireline to the BHA system 100 and may optionally have an emergency shear release feature. The emergency release will ensure that if disconnected or loss of power occurs, the devices of the BHA string 100 will be in a disengaged and open state for easy retrieval with a fishing tool. Further preferably, a blast joint for stimulating, and a fish neck for engagement with the fishing tool, can be incorporated into the cable head 16 or can optionally be separate entities.

In one embodiment, the hydraulic sealing device 4 and the hydraulic anchor 6 can be on a shared hydraulic access which can be activated and deactivated via a signal down the wireline. The signal specifically activates the motor 18 and pump 8 as well as a series of valves to allow a flow path of fluid from the accumulator 10 to the shared hydraulic access of the sealing device 4 and anchor 6. The fluid pressure applied from the pump 8 is applied via the shared hydraulic access to pressurize both anchor 6 and sealing device 4 at the same time. In the case where the mechanical cutter 12 is a hydro-mechanical cutter, the mechanical cutter 12 is hydraulically isolated from the sealing device 4 and the anchor 6 so that it is activated by a separate signal from the wireline. However it would be understood by a person of skill in the art that the hydraulic sealing device 4 and hydraulic anchor 6 could also have separate hydraulic chambers and be separately hydraulically actuated by the pump 8, with valving provided to have both the hydraulic sealing device 4 and hydraulic anchor 6 actuate at the same time. A control panel 42 can coordinate opening of access to the hydraulic anchor 6 and sealing device 4 at the same time if desired.

The hydraulic sealing device 4 of the present invention is preferably in the form of a hydraulic packer. More preferably, the hydraulic sealing device 4 comprises a single or multiple solid packing elements 24. More preferably the packing elements 24 are made of a solid elastomer or solid composite or alloy polymeric elastomer. This presents a number of advantages over inflatable-type packers, including a simpler design, durability, greater capability to be set multiple times and better sealability in higher pressure applications, high temperature applications and in harsh chemical environments. However, it would be understood by a person of skill in the art that inflatable packers could also be used for the sealing device 4 of the present invention without departing from the scope thereof.

The pump 8 and accumulator 10 are used to pump hydraulic fluid into and out of the hydraulic sealing device 4 and the hydraulic anchor 6 and optionally also the mechanical cutter 12. The pump 8 and accumulator 10 may be combined into a singular unit or be present as consecutive devices on the BHA system 100 in fluid communication with one another. The pump 8, as would be well understood, includes a motor 18 to power the pump.

The accumulator 8 uniquely stores a volume of fluid to be pumped to the hydraulic anchor 6, the hydraulic sealing device 4 and the mechanical cutter 12 to actuate these devices. The accumulator provides a closed system with clean fluid. By being able to choose the fluid used in the accumulator 10, no wellbore contaminants are allowed to enter the BHA system 100, increasing the reliability and reducing the risk of plugging up the devices with wellbore debris or debris introduced from the stimulation, such as sand. Choosing the fluid also increases the predictability of the operation of each tool since it is possible to calculate exact volumes of fluid in the tool and fluid quantities to be pumped into each section of the BHA system 100. This aids in predicting stroke length and status of activation of each device. Clean fluid also increases repeatability. While the fluid is preferably a non-compressible, low viscosity fluid, it can be any number of types of fluids including compressible gasses like air, nitrogen and others.

The pump 8 and accumulator 10 further serve to maintain all sections in an equalized pressure state when not in use.

All sections of the BHA system 100 are filled with fluid and connected to the pump 8 and accumulator 10 via tubing and a series of valves that open and close at the signal fed through the wireline 2. The accumulator 10 allows the BHA system 100 to become pressure balanced to wellbore pressure. In this way, when the pump 8 and motor 18 are activated to pressurize the sealing device 4 and anchor 6, the pressure is raised above the wellbore pressure to create the pressure differential needed to activate the packing element 24 and the anchor slips 26. In particular, the valving of the present system allows the system 100 to cycle between five positions: mechanical cutter 12 activated, mechanical cutter 12 de-activated, sealing device 4/anchor 6 activated sealing device 4/anchor 6 deactivated and neutral.

The pump 8 can be any number of types of pumps including multi- or single stage linear pump or rotary pumps, however it would be understood by a person of skill in the art that any number of other pump types could also be incorporated without altering the scope of the invention.

The casing collar locator 14 is used to correlate the measured depth of the BHA system 100 to allow positioning of the BHA system 100 at desired intervals of the formation 20. The mechanical cutter 12 in the present invention is preferably a tool that uses hydraulic pressure to actuate the radial extension of one or more blades or punches 22 towards and then into the casing 30 to thereby cut or perforate the casing 30 to create an access point to the formation 20 beyond. This form of the cutter is known as a hydro-mechanical cutter. In such embodiments, the mechanical cutter 12 is provided with hydraulic pressure from the pump 8 pumping hydraulic fluid from the accumulator 10 to the mechanical cutter 12.

It should be noted that any number of perforating, punching or cutting means can be incorporated in the present BHA system 100 without departing from the scope of the invention. For example, electrical cutting tools with a drive train or transmission or gear system to provide axial or rotational conversion of force to apply it to cutting or punching holes in the casing. Alternatively, a chemical cutter or chemical perforating tool might also be used.

Some advantages of a mechanical cutter over explosive perforators include the fact that all the parts of the mechanical cutter are reusable, and cutting multiple stages using a perforator gun requires deploying in and out of the wellbore to removed used explosives and add a new set. Also, there are safety concerns with explosive perforating that the mechanical cutter does not have.

The mechanical cutter is advantageous over fluid perforators since fluid perforators requires a conduit to supply the perforating fluid and hence cannot be run on wireline. The conduit, typically coil or jointed tubing or other, would restrict the flow area and limit the rate of fluid flow for stimulation.

In a further embodiment of the present invention, the casing 30 may be run with one or more sliding sleeve 36, also called shiftable sleeves or ported collars or ported sleeves or frac valves. Such sliding sleeves typically comprise one or more ports that allow communication between an ID of the casing and the formation beyond, and a sleeve that is moveable to either cover or expose the ports.

In such embodiment, as depicted in FIG. 7, the BHA system 100 may incorporate a shifting tool 34 in place of the mechanical cutter 12. The shifting tool 34 will preferably comprise one or more engagement mechanisms 38 that are engagable with the sleeve of the sliding sleeve 36 to shift the sleeve from a port closed position to a port exposed position. Further preferably the engagement mechanisms 38 of the shifting tool 34 are also able to engage the sleeve to shift from a port open to a port closed position. In this way, the engagement mechanisms 38 of the shifting tool are able to open, close, re-open and re-close the sliding sleeve 36 as needed.

In one embodiment, the sleeve of the sliding sleeve 36 may optionally comprise a profile that is engagable by the engagement mechanism 38 of the shifting tool 34. In other embodiments the engagement mechanism 38 may take the form of a latching mechanism to latch into a part of the sleeve. In further embodiments, the engagement mechanism may comprise, teeth or other gripping means to grip the sleeve 36.

In a further preferred embodiment, the shifting tool 34 may have a number of similar features and operate in a similar manner to the mechanical cutter 12 discussed above. In such embodiments, the shifting tool 34 would be a hydraulic shifting tool 34. However, rather than extending blades or punches 22 into the casing 30, the present shifting tool 34 can use hydraulic pressure to actuate the radial extension and axial movement of the engagement mechanisms 38 in a first direction to engage the sleeve of the sliding sleeve 36 to open the ports. In such embodiments, the shifting tool 34 is provided with hydraulic pressure from the pump 8 pumping hydraulic fluid from the accumulator 10 to the shifting tool 34.

In one embodiment, the shifting tool 34 may comprise one or more hydraulic chambers for receipt of fluid pressure from the pump 8 for radially extending and axially moving the engagement mechanisms 38. In some embodiments a single hydraulic chamber can be actuated to both radially extend and axially move the engagement mechanisms 38, and in other embodiments, separate hydraulic chambers are used of each of radial extension and axial movement. In some cases, a piston arrangement, in which the piston is hydraulically actuated to axially move the engagement mechanism 38, may be incorporated.

In some embodiments, the shifting tool would not be hydraulically actuated but instead incorporate solenoid actuation with an electrical signal from the wireline 2.

When the pump 8 pumps hydraulic fluid out of the shifting tool 34 and back to the accumulator 10, the engagement mechanisms 38 are axially moveable in a second direction to shift the sleeve of the sliding sleeve 36 to close the ports.

An unloader valve 32 serves to equalize pressure between an upper annulus 28*a* and a lower annulus 28*b* between the BHA system 2 and the casing 30 after stimulation is complete.

The operation of the present BHA system 100 is now described with reference to the figures. The BHA system 100 is deployed into the well on wireline 2 via any well-known means including pump down deployment methods, tractor method, among others. The BHA system 100 is then positioned at the first interval of interest for stimulation using feedback from the casing collar locator 14. A signal is transmitted down the wireline 2 to activating the motor 18 and pump 8 to pump fluid from the accumulator 10 into the mechanical cutter 12 up to a pre-determined pressure to activate the mechanical cutter 12. At this pressure, the mechanical cutter blades or punches 22 will engage the casing 30 and cut holes therethrough, providing access points to the formation. Once access points are established and the blades or punches 22 of the mechanical cutter 12 have made a full stroke, the mechanical cutter 12 is deactivated, and fluid will be pumped out of the mechanical cutter 12 back into the accumulator 10, which serves to retract the blades or punches 22.

Once the casing 30 has been perforated and access to a first desired interval of the formation 20 has been made, the BHA system 100 is re-positioned via pump down, tractor or other means to position below the first formation access points. A signal is then sent down the wireline 2 to pump fluid from the accumulator 10 into the shared sealing device 4 and anchor 6 hydraulic access. The pressure created by the pumped fluid serves to activate the hydraulic sealing device 4 and hydraulic anchor 6. Once the sealing device 4 and anchor 6 are set and associated tubing in that section of the BHA system 100 reach a pre-determined pressure, the pump 8 ensures that the pressurized state is held through the next steps and optionally also during stimulation.

With the sealing device 4 and anchor 6 set, the wellbobre there below is now isolated from the wellbore above it. Full-bore stimulation of the wellbore above the sealing device 4 can commence. Since the BHA system 100 is deployed on wireline, there is little to no obstruction to fluid flow down the casing and into the access points to the formation. The present hydraulic sealing device 4 solid packing element 24 ensures sealing against leaks in the high pressure application.

The present BHA system 100 preferably incorporates an active telemetry system 40, which allows for collection of real time temperature and pressure data from sensors that may then be relayed to surface during the stimulation. More particularly, the telemetry system may be comprised of one or more pressure vs. time and temperature vs time sensors located uphole of the sealing device as well as downhole the sealing device on an external surface thereof to measure annular pressures and temperatures at those points. This allows for monitoring the stimulation operations and ensures that the sealing device is sealing during the stimulation. One or more pressure vs time and temperature vs time sensors may also be placed inside of the pump or inside each of the mechanical cutter 12 and one or more sealing device 4 and anchor 6 pressure chambers to measure and record the actuating pressures for each of these tools.

Previously, the industry standard is to uses memory gauges, which collect data on the string and then store this data. Gauge data can only be seen once the system is returned to surface after the job is finished. Active real time telemetry has not been possible on previous coil or jointed tubing deployed systems since there would be no electrical conduit to run the data to surface on. Providing such a conduit, sometimes called an e-coil, can be very expensive, particularly in deep zones. In other telemetry systems that employ acoustic modulation techniques or electro-magnetic techniques such as mud pulse, acoustic, electro-magnets, low frequency radio frequency and others do not have a direct wired connection and the noise and vibration from the stimulation process is commonly so great that the signal gets lost.

Once the stimulation is complete, a signal is sent down the wireline 2 to the pump 8 to deactivate the sealing device 4 and anchor 6 by pumping fluid out of these devices and back to the accumulator 10, which serves to unset the packing element 24 of the sealing device 4 and the one or more slips 26 of the anchor 6. Optionally, the signal through the wireline may also serve to open the unloader valve 32, which serves to equalize pressure from the upper annulus 28*a* above the sealing device 4 to a lower annulus 28*b* below the sealing device 4. This in turn eases the release of the packing element 24, which in turn prolongs its stage life. In a preferred embodiment a screen may be included on the unloader valve 32 to screen wellbore fluids and screen out sand as wellbore fluids pass between the upper annulus 28*a* and the lower annulus 28*b*. In this way, harmful debris is kept out of the internal compartment of the unloader valve 32, extending its life. Movement of the BHA system from interval to interval serves to flush out the screen, making it thus self-cleaning.

The BHA system 100 can then be moved to the next interval of interest, located by correlating measured depth by the casing collar locator 14, and the process is repeated: accessing a desired interval of the formation 20 by activating the mechanical cutter 12, deactivating the mechanical cutter 12, re-positioning the BHA system 100 so that the sealing device 4 and anchor 6 are below the formation access point, activating the packing elements 24 and anchor slips 26 hydraulically by pumping fluid from the accumulator 10, stimulating the desired formation interval via the access points by full bore fluid down the casing 30, deactivating the anchor 6 and sealing device 4 by pumping fluid out of these devices back into the accumulator 10, moving to next interval of interest, and repeating for multi-interval stimulation.

In case of a screen out, the wireline 2 can be released from the cable head 16*a* by any number of means including mechanical manipulation of the wireline deployed system from surface, an electrical release mechanism operated by either the presence or absence of a signal sent down through the wireline, an explosive release mechanism also operated by either the presence or absence of a signal down through the wireline, or by a pressure activated (hydraulic) release mechanism. In some cases, such as a power outage, a lack of signal from the wireline may trigger a battery operated release mechanism that could be electrical or explosive. Once it is released, the emergency release valve that is part of the cable head becomes opened in a no power mode, which will allow all the devices in the BHA system 100 to become disengaged and pressure equalized. A clean out can then occur and a fisher tool can be attached to the fishing neck to pull the devices out of hole.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A multi-stage stimulating system, comprising:

a. one or more hydraulic sealing devices;

b. one or more hydraulic anchors;

c. a mechanical cutter;

d. an accumulator to provide a fluid source; and e. a pump fluidly connected to the accumulator for pumping fluid to and hydraulically actuating the one or more sealing devices, one or more anchors and the mechanical cutter, wherein the system is deployed via wireline.

2. The system of claim 1, wherein the one or more sealing devices and the one or more anchors are arranged with a shared hydraulic access such that the one or more sealing devices and the one or more anchors are actuated simultaneously by the pump pumping fluid from the accumulator to the shared hydraulic access.

3. The system of claim 2, wherein the mechanical cutter is hydraulically actuated separately from hydraulic actuation of the one or more sealing devices and one or more anchors.

4. The system of claim 3, further comprising a telemetry system connected to the accumulator and pump and to the one or more sealing devices, one or more anchors and the mechanical cutter to collect real time data and transmit the data to surface via the wireline.

5. The system of claim 4, wherein the telemetry system comprising one or more pressure and temperature sensors connected to the one or more sealing devices, the one or more anchors and to the mechanical cutter.

6. The system of claim 1, wherein the one or more hydraulic sealing devices are hydraulic packers.

7. The system of claim 6, wherein the one or more hydraulic packers are solid element packers.

8. The system of claim 1, wherein the mechanical cutter is a hydro-mechanical cutter.

9. The system of claim 8, wherein the hydro-mechanical cutter comprises one or more blades or punches that are radially extendable by hydraulic pressure from the pump, towards and then into a casing to be perforated, to create an access point through the casing.

10. A method of stimulating multiple intervals of a subterranean formation, said method comprising the steps of:

a. running a bottom hole assembly down a wellbore casing on a wireline, said bottom hole assembly comprising: one or more hydraulic sealing devices, one or more hydraulic anchors, a mechanical cutter, an accumulator to provide a fluid source and a pump fluidly connected to the accumulator;

b. actuating the mechanical cutter;

c. cutting one or more perforations into the casing to form access points to the formation;

d. pumping fluid out of the mechanical cutter to deactivate the mechanical cutter;

e. re-positioning the bottom hole assembly;

f. pumping fluid from the accumulator to the one or more hydraulic sealing devices and one or more hydraulic anchors to hydraulically actuate the one or more hydraulic sealing devices and one or more hydraulic anchors to isolate the interval of the formation to be stimulated;

g. stimulating the interval of the formation through the access points with fluid delivered through the casing;

h. pumping fluid out of the one or more hydraulic sealing devices and one or more hydraulic anchors to deactivate the one or more hydraulic sealing devices and one or more hydraulic anchors; and i. repositioning the bottom hole assembly;

wherein the steps of the method are repeated for every interval of the formation to be stimulated.

11. The method of claim 10, wherein actuating the mechanical cutter comprises pumping fluid from the accumulator to the mechanical cutter to radially extend one or more blades or punches from the mechanical cutter towards and into a casing to be perforated, to thereby create an access point through the casing.

12. The method of claim 10, further comprising: collecting via sensors, data on the stimulation operation, operation of the one or more sealing devices, one or more anchors and the mechanical cutter; and relaying the data collected in real time to surface.

13. The method of claim 10, wherein hydraulically actuating the one or more hydraulic sealing devices and one or more hydraulic anchors comprises pumping fluid from the accumulator to a shared hydraulic access of the one or more hydraulic sealing devices and one or more hydraulic anchors to simultaneously actuate the hydraulic sealing devices and hydraulic anchors.

14. The method of claim 10, further comprising equalizing pressure uphole of the one or more sealing devices with wellbore pressure downhole of the one or more sealing devices during deactivating said sealing devices.

15. The method of claim 10, wherein pumping fluid between the accumulator and the one or more sealing device, one or more anchor and the mechanical cutter is directed by a system of tubing and valving and controlled by a control panel within the system.

* * * * *